United States Patent [19]

Johns

[11] 4,410,579

[45] Oct. 18, 1983

[54] NONWOVEN FABRIC OF RIBBON-SHAPED POLYESTER FIBERS

[75] Inventor: Martha M. Johns, Wilmington, Del.

[73] Assignee: E. I. Du Pont de Nemours and Company, Wilmington, Del.

[21] Appl. No.: 423,061

[22] Filed: Sep. 24, 1982

[51] Int. Cl.[3] ..... D04H 3/08; D06C 1/06

[52] U.S. Cl. ..... 428/131; 28/104; 28/105; 28/106; 428/134; 428/280; 428/288; 428/290; 428/359; 428/397

[58] Field of Search ..... 428/131, 134, 280, 288, 428/290, 359, 397; 28/104, 105, 106

[56] References Cited

U.S. PATENT DOCUMENTS 3,485,706 12/1969 Evans .
3,797,074 3/1974 Zafiroglu .
4,069,563 1/1978 Contractor et al. .

OTHER PUBLICATIONS

Sontara ® Spunlaced Fabrics of 100% Polyester Fiber, Bulletin SN-1, Jun. 1979.

M. M. Johns & L. A. Auspos, "The Measurement of Resistance to Disentanglement of Spunlaced Fabrics", INDA, New Orleans, (Mar. 1979), 158-174.

*Primary Examiner*—Marion McCamish

[57] ABSTRACT

Apertured nonwoven fabrics prepared by hydraulic entanglement of polyethylene terephthalate staple fibers of ribbon cross-section have unusually high resistance to disentanglement when the aspect ratio of the fiber cross-section (i.e., ratio of major to minor axis) is in the range of 1.8 to 3.0.

3 Claims, 2 Drawing Figures

NONWOVEN FABRIC OF RIBBON-SHAPED POLYESTER FIBERS

BACKGROUND OF THE INVENTION

1. Field of the Invention

This invention relates to apertured nonwoven fabrics made of hydraulically entangled polyester staple fibers. In particular, the invention concerns such fabrics of improved disentanglement resistance in which the fibers have a particular ribbon-shaped cross-section.

2. Description of the Prior Art

Nonwoven fabrics in which hydraulically entangled, staple fibers form a strong, apertured structure, without the presence of resin binder or fiber-to-fiber melt bonds, are known in the art. For example, U.S. Pat. No. 3,485,706 broadly discloses that apertured nonwoven fabrics can be made by hydraulic entanglement techniques from a wide variety of fibers of different cross-sections, denier, length, composition, etc. More recent disclosures of preferred methods of making such fabrics are found in U.S. Pat. No. 4,069,563. Commercial fabrics of this type made from polyester fibers of circular cross-section are disclosed in Du Pont Technical Information Bulletin SN-1, "Properties and Processing Sontara® Spunlaced Fabrics of 100% Polyester Fiber," June 1979. Although such nonwoven fabrics have found application in a wide variety of products, increased disentanglement resistance would enhance their utility and versatility of the fabrics. The importance of disentanglement resistance to the surface stability, strength, washability, etc. of spunlaced fabrics is disclosed in M. M. Johns & L. A. Auspos "The Measurement of the Resistance to Disentanglement of Spunlaced Fabrics," Symposium Papers, Technical Symposium, *Nonwoven Technology—Its Impact on the 80's*, INDA, New Orleans, Louisiana, 158—174 (March 1979). The purpose of this invention is to provide such spunlaced fabrics with improved resistance to disentanglement.

SUMMARY OF THE INVENTION

The present invention provides an improved, apertured, nonwoven fabric of polyester staple fibers. For increased resistance to disentanglement, the fibers of the improved fabric have ribbon-shaped cross-sections whose aspect ratio is in the range of 1.8:1 to 3:1, preferably 2:1 to 2.5:1. Surprisingly, these fabrics exhibit a disentanglement resistance that is much greater than that of nonwoven fibers prepared in the same way from similar fabrics of circular cross-section or of ribbon-shaped cross-section whose aspect ratio is outside the aforementioned ranges.

BRIEF DESCRIPTION OF THE DRAWINGS

The invention will be understood more readily by reference to the drawings which illustrate effects of the aspect ratio of the fiber cross-section on important properties of hydraulically-entangled, apertured nonwoven fabrics.

DETAILED DESCRIPTION OF PREFERRED EMBODIMENTS

Figure 1:
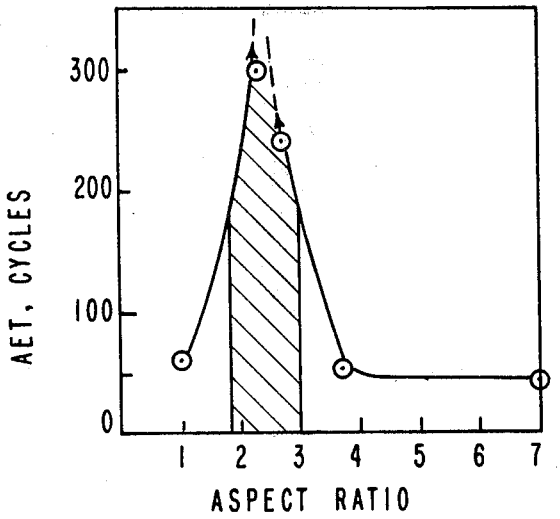
FIG. 1 is a graph of disentanglement resistance versus aspect ratio.
Figure 2:
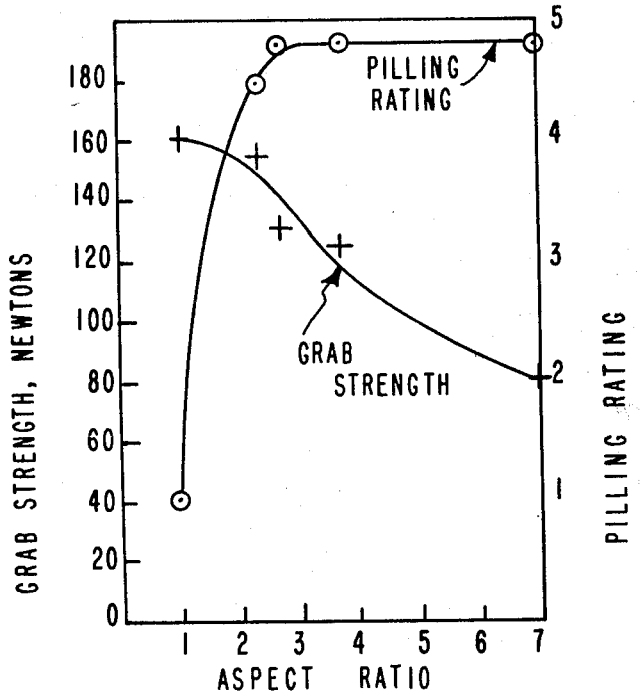
FIG. 2 is a graph of grab strength and pilling resistance as functions of aspect ratio.

The key advantage of the present invention is illustrated in the graphs of FIGS. 1 and 2. The data from which these graphs were derived are given in detail hereinafter in Example I. Note in FIG. 1, the extraordinary increase in disentanglement resistance that was obtained when the apertured, hydraulically entangled, nonwoven fabrics of Example I were prepared from ribbon-shaped polyester staple fibers whose aspect ratio is in the range prescribed by the present invention, i.e., 1.8:1 to 3:1. Aspect ratio is defined as the ratio of the length of the major axis to the length of the minor axis of the cross-section. Fabrics made with fibers which had cross-section aspect ratios in this range had resistances to disentanglement, measured in cycles by the Alternate Extension Test (hereinafter "AET") described in the article by M. M. Johns & L. A. Auspos referred to above, in the range of from about 150 to well above 300 cycles. In contrast, fabrics made under the same conditions with polyester staple fibers of the same denier and length but of circular cross-section (i.e., having an aspect ratio of 1.0), had AET disentanglement values of less than 75 cycles. For the types of apertured nonwoven fabrics made in Example I, AET values of over 240 cycles were obtained when polyester fibers having a cross-section aspect ratio in the range of 2.0 to 2.5 were used in the fabrication. These effects of aspect ratio on the resistance to disentanglement were completely unpredictable and unexpected from the disclosures of the prior art.

As used herein, the term "ribbon-shaped" means generally rectangular or oval in shape.

Generally, the polyester staple fibers which are suitable for use in the apertured nonwoven fabrics of the present invention have a denier in the range of about 1 to 5 (1.1 to 5.6 dtex) and a length in the range of $\frac{1}{2}$ to 2 inches (1.3 to 5 cm). For improved surface fiber stability and surface abrasion resistance, fibers of about $\frac{1}{2}$ to 1 inch (1.3 to 2.5 cm) are preferred. Particularly useful in the present invention are polyester fibers of about 1.5 denier per filament (1.7 dtex) and about $\frac{3}{4}$-inch (1.9 cm) length. All of the ribbon-shaped polyester fibers which are suitable for use in the present invention can be melt spun from rectangular orifices, drawn, heat-relaxed and cut into staple-fiber length by conventional techniques. The fibers can then be formed into webs by known techniques which employ cards, Rando-webbers or air-laydown equipment such as that disclosed in U.S. Pat. No. 3,797,074. Known methods of hydraulically entangling the fiber webs into apertured nonwoven fabrics, such as those disclosed in U.S. Pat. Nos. 3,485,706 and 4,069,563, can be used in the present invention.

In making the apertured nonwoven fabrics of the present invention by hydraulic entanglement, the polyester staple fiber web is entangled while in place on a foraminous support. Generally, the support will be in the form of a woven wire screen having a mesh of 60 (i.e., 23.6 wires/cm) or less in at least one direction and an open area of at least 20%. Alternatively, an apertured plate having a corresponding number of openings and open area can be used.

The supported web can then be treated by fine, columnar streams of water, preferably supplied at a gauge pressure of at least 200 psi (1379 kPa) from a row or rows of small-diameter (e.g., 3 to 7 mils [0.076–0.178 mm]) orifices evenly spaced at 10 to 60 per inch (3.9 to 23.6/cm) in each row. The fine columnar streams supply an energy flux at the web of at least 23,000 ft-poundals/in$^2$ sec (9000 Joules/cm$^2$ min) to provide a total energy of impingement of at least 0.1 Hp-hr/$lb_m$ ($0.59\times10^6$ J/kg) of fabric. Usually pressures of greater than 2000 psi (13,790 kPa) are not necessary.

The apertured nonwoven product of the present invention is characterized by dense regions of entangled fibers in which the entanglement is three dimensional (i.e., the fibers extend through the thickness of the fabric and are entangled through the thickness). The dense entangled regions are interconnected by groups of fibers. The entangled regions together with the interconnected fiber groups define the apertures in the fabric.

The pattern of apertures in the nonwoven fabric depends on the apertures in the woven screens. The apertures in the fabric form in regions of knuckles formed by the crimp of the interwoven wires of the support screen. As disclosed in U.S. Pat. No. 3,485,706 various patterns can be formed in hydraulically entangled, apertured nonwoven fabrics. A preferred pattern is one that gives the appearance of a hopsack cloth, as described in Example I.

The weight of the web is selected with regard to the use intended for the fabric. Generally, the unit weight of the web is in the range of 0.5 to 3.5 oz/yd$^2$ (17 to 119 g/m$^2$) and preferably in the range of 0.8 to 2.2 oz/yd$^2$ (27 to 75 g/m$^2$).

In the examples below, the following test procedures were used to measure various properties of the fibers used and the nonwoven fabrics produced. All measurements are made on dried fabrics or fibers.

Cross-section aspect ratio of fiber is measured conveniently by making photomicrographs of the cross-section of the fiber (cut perpendicular to the long axis of the fiber); measuring the lengths of the short and long axes of the cross-section; and then calculating the length ratio of long axis to short axis. At least ten fiber cross-sections are measured thusly to obtain a statistically representative value for the fibers used in making the fabric.

Disentanglement resistance of fabric is measured in cycles by the Alternate Extension Test (AET) described by Johns & Auspos on pages 158–162 in the INDA symposium paper referred to in the second paragraph of this application.

Grab; tensile strength is reported for 1-inch (2.54-cm) wide strips of fabric. Machine direction (MD) and crossmachine direction (XD) measurements are made with an Instron machine by ASTM Method D-1682-64 with a clamping system having a 1×3 inch (2.54×7.62 cm) back face (with the 2.54 cm dimension in the vertical or pulling direction) and a 1.5×1 inch (3.81×2.54 cm) front face (with the 3.81 cm dimension in the vertical or pulling direction) to provide a clamping area of 2.54×2.54 cm. A 4×6 inch (10.16×15.24 cm) sample is tested with its long direction in the pulling direction and mounted between 2 sets of clamps at a 3-inch (7.62 cm) gauge length (i.e., length of sample between clamped areas). The average of the MD and XD values are reported. Break elongation values are measured at the same time and reported in the same manner.

Pilling resistance of fabric is rated after five wash and dry cycles in laundering equipment. Samples measuring 20 by 20 inches (50.8 by 50.8 cm) are layered to form a composite sample weighing 6 to 8 oz/yd$^2$ (203 to 271 g/m$^2$). Such samples plus about 30 grams of detergent and cotton diapers about equal in weight to the composite are loaded into an automatic washer, for a 12-minute agitation cycle after the water has reached the high water level. Water temperature is at about 40° C. The purpose of the cotton diapers is to promote linting and pilling. After each spin-dry cycle of the washer, the load of samples and diapers are tumble-dried for 25 minutes with heated air exiting at a temperature of 68–71° C. followed by 5 minutes tumbling with air at room temperature. After five such wash-dry cycles the samples are rated at integers between 1 and 5. A rating of 5 indicates no change in the sample as a result of the laundering and drying. A rating of 1 indicates gross changes and much pilling.

Fiber tensile strength and elongation are measured by ASTM-D-3822-79. Crimps per unit length are measured by ASTM-D-3937-81.

EXAMPLE I

This example illustrates the surprisingly narrow range of ribbon cross-section polyester fibers that are suitable for the hydraulically entangled nonwoven fabrics of the invention.

Polyester staple fibers were processed into 2.0 oz/yd$^2$ (67.8 g/m$^2$) webs on a "Rando-Webber" air-lay-down machine. All fibers had a denier of about 1.5 (1.65 dtex) per filament, a length of about ¾ inch (1.9 cm), and had been made by conventional techniques which included melt spinning of polyethylene terephthalate polymer into filaments, applying about 0.1% by weight of fiber of a surface-lubricating agent, single-stage drawing followed by heat relaxation at 130° C. and then cutting of the filaments into staple length. Fibers of five different cross-sections were used. The characteristics of the fibers are listed in Table I.

TABLE I

| Fiber Cross-Section | Aspect Ratio | Tenacity g/den | Tenacity (g/dtex) | Elongation % | Crimps Per cm |
|---|---|---|---|---|---|
| Circular | 1.0 | 4.7 | (4.3) | 33 | 3.1 |
| Ribbon | 2.3 | 4.4 | (4.0) | 36 | 2.8 |
| Ribbon | 2.7 | 3.3 | (3.0) | 62 | 3.5 |
| Ribbon | 3.7 | 3.7 | (3.4) | 28 | 4.7 |
| Ribbon | 7.0 | 3.6 | (3.3) | 16 | 4.7 |

Webs were prepared from each of the above-described samples of fibers. Each web was wetted with water, placed on a screen and then hydraulically entangled by a series of passes at a speed of 25 yards/min (23 m/min) under a row of substantially columnar jets having a divergence angle of generally less than one degree. The jets emerged from rows of orifices which were positioned perpendicular to the direction of travel of the web. Each orifice was 0.005 inch (0.013 cm) in diameter and was located one inch (2.5 cm) above the surface of the web. Two sets of orifices and two screens were used. Orifice Set. No. 1 contained 60 orifices per inch (23.6/cm) located in a single row. Set No. 2 contained 40 orifices per inch (15.7/cm) arranged in two staggered rows, spaced 0.04 inch (0.10 cm) apart, each row containing 20 orifices per inch (7.9/cm). The screens that were used are described as follows:

| | Screen No. 1 | Screen No. 2 |
|---|---|---|
| Type | Semi-twill | Standard weave |
| % Open Area | 21 | 40 |
| Wires per inch | 75 × 58 | 20 × 20 |
| (Wire per cm) | (29.5 × 22.8) | (7.9 × 7.9) |

Hydraulic Entanglement Treatment

| Pass | Orifice Set No. | Screen No. | Water psi | Pressure (kPa) |
|---|---|---|---|---|

-continued

| | | | | |
|---|---|---|---|---|
| 1 | 2 | 1 | 500 | (3,450) |
| 2 | 2 | 1 | 1000 | (6,900) |
| 3, 4, 5 | 2 | 1 | 1800 | (12,400) |
| 6 | 2 | 2 | 500 | (3,450) |
| 7, 8 | 2 | 2 | 1,800 | (12,400) |
| 9, 10 | 1 | 2 | 1,800 | (12,400) |

Between passes 5 and 6, the web was removed from screen No. 1, turned over and placed atop screen No. 2. The total energy expended in hydraulically entangling these webs was 1.25 horsepower hours per pound ($7.4\times10^6$ Joules/kg). As a result of the treatment, hopsack patterned, apertured nonwoven fabrics were produced having the characteristics listed in Table II.

TABLE II

| Fiber | Fabric Characteristics | | | |
|---|---|---|---|---|
| Aspect Ratio | AET Cycles | Grab Strength lb-f (N) | Elongation % | Pilling Rating |
| *1.0 | 64 | 36.2 (161) | 63 | 1.0 |
| 2.3 | >300 | 35.1 (156) | 60 | 4.5 |
| 2.7 | >243 | 29.5 (131) | 65 | 4.8 |
| *3.7 | 55 | 28.2 (125) | 64 | 4.8 |
| *7.0 | 45 | 17.9 (80) | 56 | 4.8 |

*Comparison Examples

The disentanglement resistance (AET cycles) of these five fabrics are plotted in FIG. 1 as a function of aspect ratio. Notice the extraordinarily high values of AET cycles for fabrics which were made with fibers having an aspect ratio in the range of 1.8:1 to 3:1 (i.e., values of over 160 cycles). In the range of aspect ratios from 2.1:1 to 2.5:1 values of greater than 240 cycles were recorded. Note that, as shown in Table II above and in FIG. 2, over these ranges in aspect ratio, these fabrics of the invention had satisfactory grab strengths which were no less than about 85% of the grab strength of similar fabrics prepared with polyester fibers of circular cross-section, but that these fabrics of the invention also had much superior ratings in pilling resistance.

EXAMPLE II

Two batches of 1.5-inch (3.8-cm) long staple fibers of polyethylene terephthalate were prepared. One batch had fibers of ribbon-shaped cross-section of 2.1 aspect ratio, 1.55 den (1.7 dtex) and 4.2 gpd (3.8 g/dtex) tenacity. The second batch had fibers of circular cross-section of 1.0 aspect ratio, 1.5 den (1.65 dtex) and 4.1 gpd (3.7 g/dtex) tenacity. Webs, weighing 2.4 oz/yd$_2$ (81.4 g/m$^2$), consisting essentially of fibers from only one or the other batch were prepared and hydraulically entangled with the same equipment as in Example I under a series of different entanglement energy conditions. As shown in Table III, the resulting resistance to disentanglement in AET cycles was much greater for the fabrics made of ribbon-shaped fibers rather than circular fibers, over the entire range of entanglement energies tested. In addition, the pilling resistance of products made with ribbon-shaped fiber was much greater than that of the products made with circular fibers.

TABLE III

| | Sample | Comparison |
|---|---|---|
| Fiber Type | Ribbon | Circular |
| Aspect ratio | 2.1 | 1.0 |
| Alternate Extension Test | | |
| IXE of fabrication* | AET Cycles | |
| 0.019 ($5.0\times10^5$) | >132 | 32 |
| 0.030 ($7.9\times10^5$) | >250 | 56 |
| 0.042 ($11.0\times10^5$) | >250 | 40 |
| 0.058 ($15.3\times10^5$) | 435 | 48 |

*IXE is given in hp-hr. lb-f/lb-m (N.J/kg)

As many apparently widely different embodiments of this invention may be made without departing from the spirit and scope thereof, it is to be understood that this invention is not limited to the specific embodiments thereof, except as defined in the appended claims.

What is claimed is:

1. An improved apertured nonwoven fabric consisting essentially of hydraulically entangled staple fibers of polyester polymer, wherein the improvement comprises for increased resistance to disentanglement, the staple fibers being of ribbon-shaped cross-section whose aspect ratio is in the range of 1.8:1 to 3:1.

2. A nonwoven fabric of claim 1, wherein the aspect ratio is in the range of 2:1 to 2.5:1 and the average fiber length is in the range of 1 to 3.5 cm.

3. In a process for preparing apertured nonwoven fabric by treating staple polyester fiber webs with fine columnar streams of liquid while the webs are supported on a foraminous screen, the improvement comprising the staple fibers being of ribbon-shaped cross-section whose aspect ratio is in the range of 1.8:1 to 3:1.

* * * * *